United States Patent [19]

Soubeyrat

[11] 4,164,110

[45] Aug. 14, 1979

[54] METHOD FOR FIXING PROTECTIVE SHEETS ABOUT ROLLS OF MATERIAL

[76] Inventor: Michel Soubeyrat, Residence Duplessis, 38300 Bourgoine-Jallieu, France

[21] Appl. No.: 798,630

[22] Filed: May 19, 1977

[30] Foreign Application Priority Data

May 19, 1976 [FR] France ..... 76 15858

[51] Int. Cl.[2] ..... B65B 25/24

[52] U.S. Cl. ..... 53/409; 53/461

[58] Field of Search ..... 53/13, 204, 330, 362, 53/409, 461; 29/228, 234, 235, 282, 446, 523; 206/54, 397, 407, 410, 413, 414, 415, 416; 242/68.6, 81; 72/146; 285/258, 382.4

[56] References Cited

U.S. PATENT DOCUMENTS

| | | | |
|---|---|---|---|
| 1,102,163 | 6/1914 | Opperud | 29/523 |
| 1,528,821 | 3/1925 | Flagge | 206/41 J |
| 1,902,491 | 3/1933 | Dahl et al. | 72/146 |
| 2,381,460 | 8/1945 | Meyer | 93/81 R |
| 2,423,965 | 7/1947 | Coyle | 53/362 |
| 3,387,352 | 6/1968 | Walter | 29/23 J |
| 3,402,809 | 9/1968 | Snyder | 206/410 |
| 3,608,348 | 9/1971 | McKee | 72/146 |
| 3,670,877 | 6/1972 | Reed | 53/13 X |
| 3,678,560 | 7/1972 | Dufour et al. | 29/235 X |
| 4,036,084 | 7/1977 | Schirmer | 29/228 |

FOREIGN PATENT DOCUMENTS

| | | | |
|---|---|---|---|
| 2122360 | 11/1972 | Fed. Rep. of Germany | 206/413 |

*Primary Examiner*—John Sipos

*Attorney, Agent, or Firm*—Arnold, White & Durkee

[57] ABSTRACT

Method and apparatus for fixing a protective sheet to a roll of material such as fabric or carpet, and having a longitudinal bore therein, in which the roll is covered with a sheet of paper or plastics material, for example, the width of which is greater than the width of the roll, the ends of the sheet are folded over the ends of the roll and are inserted into the ends of the bore, and a gripper element is introduced into the ends of the bore and is deformed permanently by expanding it radially outwardly into contact with the ends of the sheet and urging these ends against the inner wall of the bore.

5 Claims, 14 Drawing Figures

METHOD FOR FIXING PROTECTIVE SHEETS ABOUT ROLLS OF MATERIAL

The present invention relates to a method and apparatus for fixing protective sheets about rolls of material which have an internal longitudinal bore.

Numerous materials such as fabrics carpets, etc, are stored and transported in the form of rolls about a carrier having an internal longitudinal bore, for example a tube made, for example, of cardboard or the like.

In order to protect these rolls during handling and storage, they are usually covered with a protective sheet, for example a plastic film or a paper sheet. The ends of this sheet, which cover the sides, ae tucked inside the bore of the tube and wedged in this bore by means such as cones made of wood or of plastic which are forced into place. However, such a method of operation suffers from numerous disadvantages since the quantity of material folded inside the bore is not constant. Thus, in certain cases it is possible for over-filling to occur which leads to tearing or pulling out of the material and in other cases if there is too little material, or if the diameter of the tube is too large, poor gripping can occur therein which sometimes necessitates a supplementary stapling operation.

Moreover, it is necessary to have different cones depending on the internal diameter of the tubes.

Finally the gripping cones generally project beyond the end of the tube in an irregular manner which increases the risk of accidents during the handling operations.

According to the present invention there is provided a method of fixing a protective sheet to a roll of material having a longitudinal bore therein, comprising covering the roll with a sheet the width of which is greater than the length of the roll, folding the ends of the sheet over the ends of the roll, inserting the ends of the sheets into the ends of the bore, introducing a gripping element into the ends of the bore and deforming the gripping by expanding it radially outwardly into contact with the ends of the sheet and urging these against the inner wall of the bore.

Such a method overcomes the disadvantages of the prior methods and makes it possible to secure and to fix in a stable and firm manner the flexible protective sheets covering rolls of material about carrier tubes, irrespective of the quantity of sheets introduced into the tube and/or the internal diameter of the carrier tube for the roll.

In accordance with the invention, the permanent deformation of the gripping element can be either a uniform deformation for example an expansion or a localised deformation of a continuous part of its surface or of certain zones spaced out over the said surface.

Optionally the gripping elements can also be glued against the protective sheet after their deformation, which further improves the cohesion of the assembly and the holding in position of the protective envelope.

The invention also provides apparatus for fixing a protective sheet to a roll of material having a longitudinal bore therein, said apparatus comprising a radially deformable gripping element and means for deforming said gripping element radially outwardly after insertion into the ends of the bore of the roll.

The gripping elements may be in the form of a tubular cylindrical or conical ring, made from metal plate, metal sheet or plastic, optionally comprising an external radial flange which bears against the end of the roll. The radial expansion can be achieved by means which bear directly against the internal surface of the ring. In general, these means are independent, for example being in the form of a pistol grip device which is easy to handle and to transport and has an expansible end.

The flange further improves the holding in position of the protective envelope for the roll and moreover, it facilitates storage of the said rings by stacking, as well as their positioning at the end of the internal bore of the roll.

In addition, in certain cases, this base can be used to hold a protective element for the ends of the roll.

A metal, for example steel plate, which can easily be deformed permanently under the action of pressure will preferably be used as the material from which the deformable gripping element is made. In general, rings made of steel, of aluminium, of plastic or of various compounds are used, having a thickness of between 0.2 and 4 millimeters, which can be deformed easily under the action of pressure and which retain this deformation after removal of the pressure.

In one variant of the invention, the deformable gripping element is in the form of a tubular ring obtained by rolling a metal strip, preferably directly about the component which produces the deformation, the winding being carried out so that the edges of the metal strip are covered. In this case, the action of the means of deformation produces an expansion of the wound metallic strip, the edges of the latter sliding over one another.

Advantageously, these edges are optionally fixed firmly after or during the expansion, for example, by welding, by stapling, by gluing or by any other equivalent means.

When the fixing is effected by gluing, a glue is preferably used whose adhesive properties are developed by the action of heat. This glue is preferably deposited on the surface of the metal strip before the formation of the roll.

According to this embodiment, where the gripping element is produced by winding a metal strip, it is advantageous to wind the strip which forms the gripping element in the form of several successive layers wound substantially in the form of spirals, like a spring. In this way, it is possible, during the expansion, to effect a rotation of the element producing the expansion, in a direction opposite to the direction of winding of the metal sheet.

Thus, an unwinding of the said winding is produced which further increases the gripping effect.

As stated previously, the volume of the gripping element in the undeformed state, that is to say, in the preferred embodiment of carrying out the invention, the volume occupied by the gripping ring is less than the internal volume of the cavity of the tube. In general, the volume of the ring in the undeformed state is about 20% to 50% less than that occupied by the ring after deformation, which makes it possible, firstly, to introduce the ring easily, even if a large quantity of the material forming the protective envelope has been folded into the tube, and secondly, makes it optionally possible to use the same type of ring for different tubes.

One embodiment of the means for engaging the ring is in the form of a pistol grip device activating a sliding rod, at the end of which is fixed a stop so that operation of the device compresses a sleeve of compressible material, for example made of rubber, against a fixed stop, forming the body of the pistol grip device.

In the present description, the term "compressible" is not used in its usual sense, but is used to denote an elastically deformable material which, under the action of localised pressure, tends to flatten along the direction exerted by this pressure and to dilate in the other directions which are not subjected to the pressure, the material regaining its original shape when the pressure ceases.

According to the invention, the sleeve of compressible material occupies, in the uncompressed state, a volume which is slightly less than the internal volume of the gripping element.

In a variant, this device is also in the form of a pistol grip device which activates a sliding rod at the end of which a mandrel is fixed comprising segments which spread outwards during the displacement of the sliding rod. When a metal sheet wound in the form of a spiral is used as the gripping element, the edges of the said sheet being glued after deformation, the pistol grip device preferably contains means of heating, and optionally, means of cooling, which make it possible to develop the adhesive properties of the material.

In order that the invention will be better understood, the following description is given, merely by way of example, reference being made to the accompanying drawings, in which.

Figure 1:
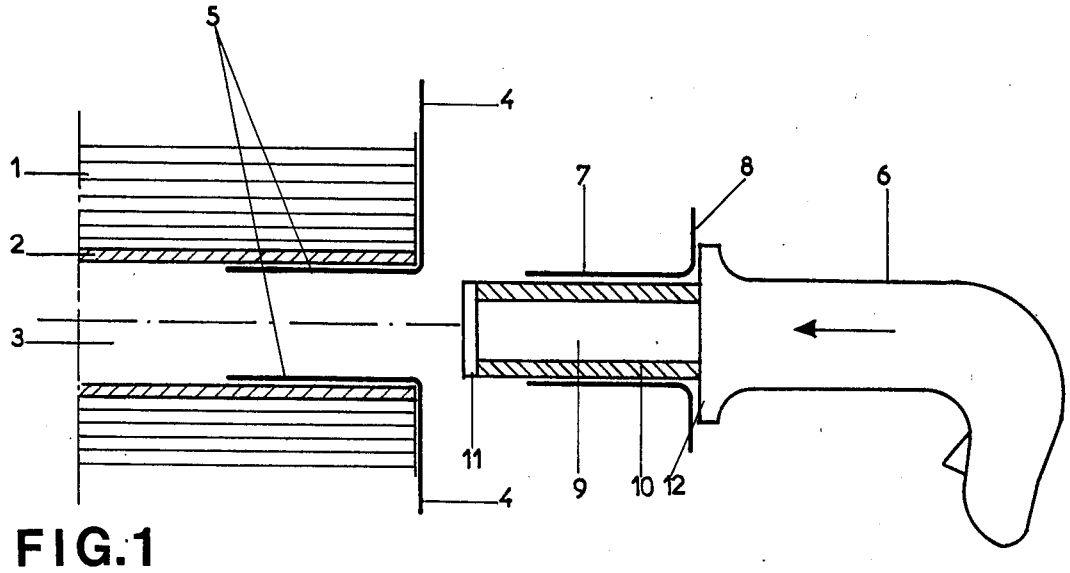
FIGS. 1, 2, 3 and 4 show, in partial section, the different phases of one way of carrying out the method according to the invention.

As shown in FIGS. 1, 2, 3 and 4, the material 1, for example fabric, is wound around a carrier tube 2 which has an internal bore 3.

The roll of material 1 is covered with a protective sheet 4 of a width which is sufficient for it also to be able to cover the ends of the roll, the end 5 of the sheet 4 being introduced inside the bore 3 of the carrier tube 2.

When this operation is completed, a gripping element 7 is introduced into the cavity 3 by means of a pistol grip device 6 and deformation of this element will be produced by the action of an internal stress which tends to cause the element to flatten against the wall of the tube 2.

In this instance, the gripping element 7 is a cylindrical ring, the outer diameter of which is less than the diameter of the bore 3 of the tube, the ring having an annular shoulder 8 at one of its ends.

To facilitate the introduction and the deformation of the gripping element one will advantageously use a portable device, which is in the form of a pistol gripping device 6 activating a moveable rod 9. A sleeve 10, made of rubber, is fitted on this rod 9, this sleeve resting at one end, against a stop 11 which is integral with the end of the rod 9 and, at the other end, against the front face 12 of the pistol grip device 6. In the uncompressed position, as is represented in FIG. 1, the outer diameter of the sleeve 10 corresponds substantially with that of the inner diameter of the ring 7.

Figure 2:
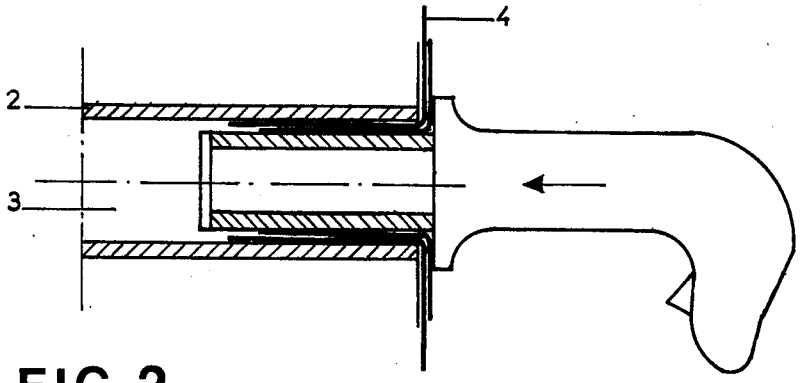

After the introduction of the ends 5 of the sheet 4 into the bore 3, the ring 7 is introduced into the bore, either by hand, or as is shown in FIGS. 1 and 2, by pre-fitting the ring 7 on the sleeve 10 of the pistol grip device.

Figure 3:
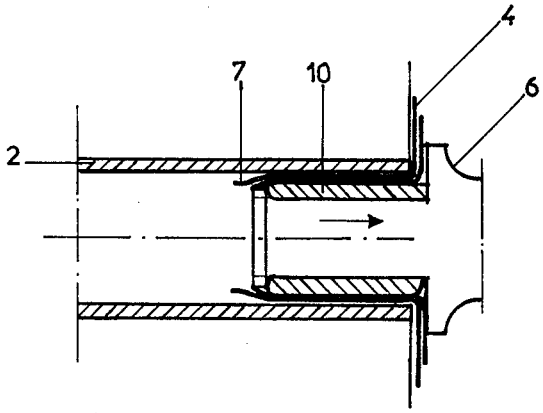

After the introduction of the ring 7 and the the moveable rod 9 and the sleeve 10 of the pistol grip device 6 into the cavity 3 of the tube 2, as shown in FIG. 2, permanent deformation of the ring 7 is caused with gripping of the sheet 4 between this ring and the inner wall of the tube 2. For that to occur, as is shown in FIG. 3, the pistol grip device is actuated and the rod 9 draws back and in its movement therefore causes the sleeve 10 to be compressed between the stop 11 and the front face 12 of the pistol grip device 6 which is held flat against the side of the roll 1. Thereafter, the sleeve 10 flattens and dilates and therefore causes the ring 7 to deform and grip the sheet 4 firmly against the wall of the cavity 3 of the tube 2.

The action of the pistol grip device can then be released and the device is withdrawn (see FIG. 3), the ring 7 remaining deformed.

Figure 11:
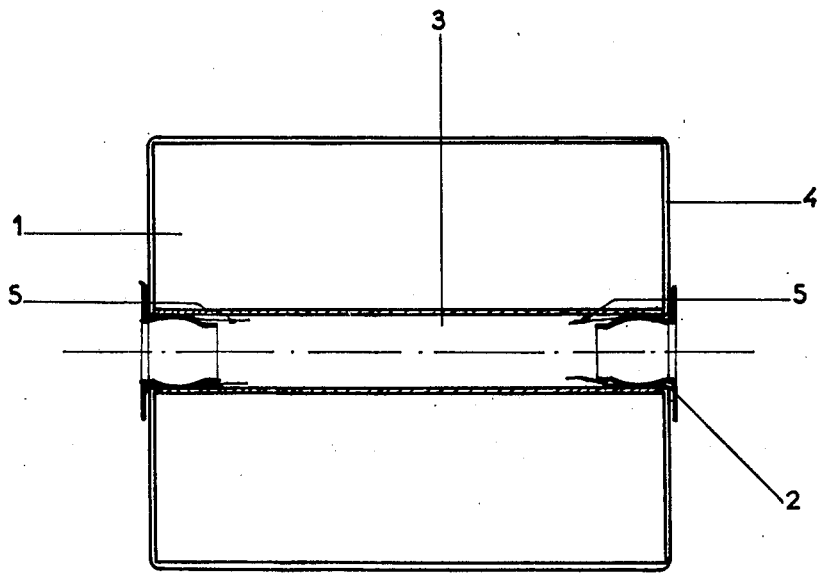
FIG. 11 shows a roll protected by an outer envelope in accordance with the invention.

FIG. 11 illustrates a roll of material 1 wound on a tube 2 and protected by a sheet 4 which is held firmly by means of gripping elements 7 by the method according to the invention.

The invention however is not limited to this embodiment and different variants are possible, for example, as is illustrated in FIGS. 5, 6, 7, 8, 9 and 10.

Figure 8:
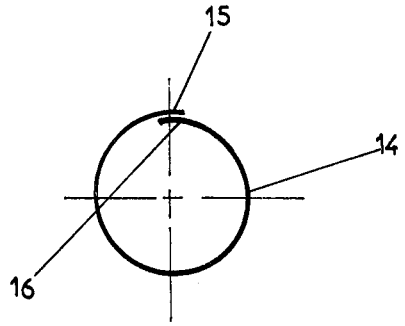

Thus, the gripping ring can be, if desired, of a conical shape (FIG. 5) or can be obtained, as is shown in FIG. 8, by winding a metal strip 14, or a similar material, so that the edges 15 and 16 of the metal strip overlap. In this case, the action of the means of deformation causes an expansion of the wound metal strip, the ends 15 and 16 sliding over one another, and it is optionally possible for these to be fixed firmly after/or during the expansion for example by welding, by stapling, by glueing or by other equivalent means.

Figure 13:
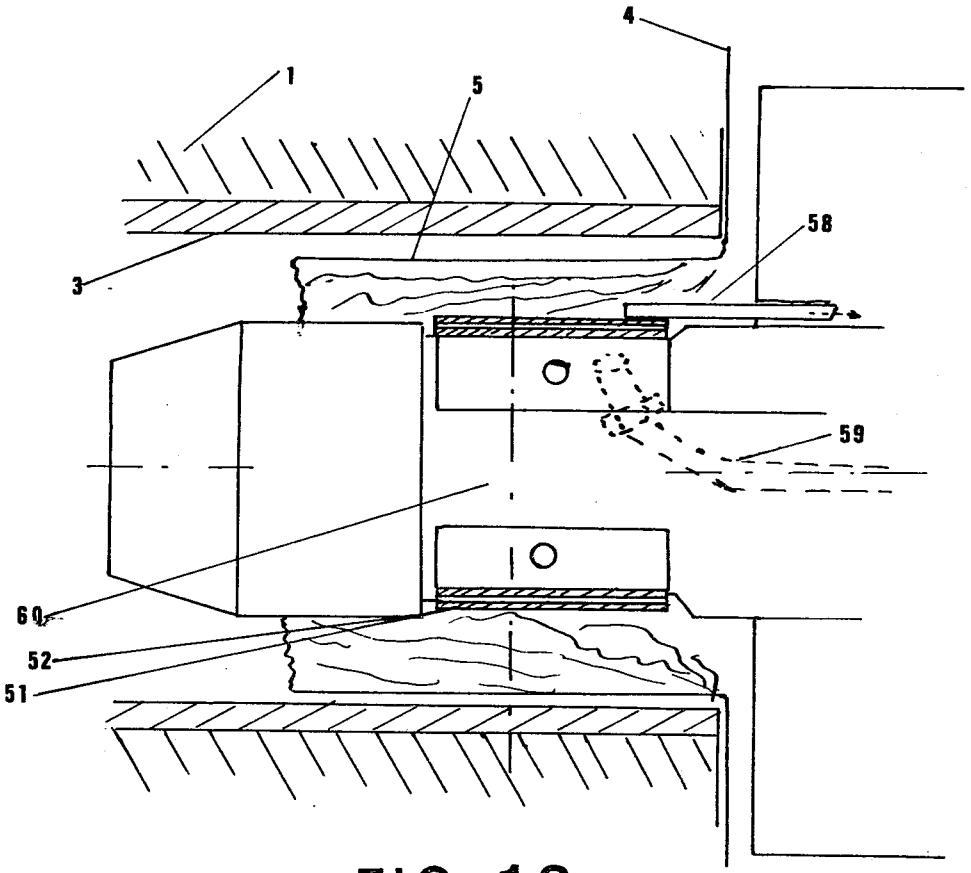
FIGS. 12, 13 and 14 illustrate a further way of carrying out the method according to the invention.
Figure 12:
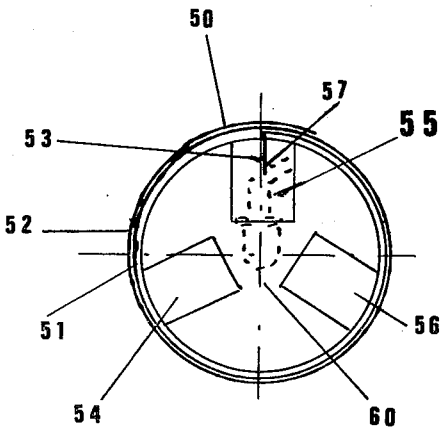
Figure 14:
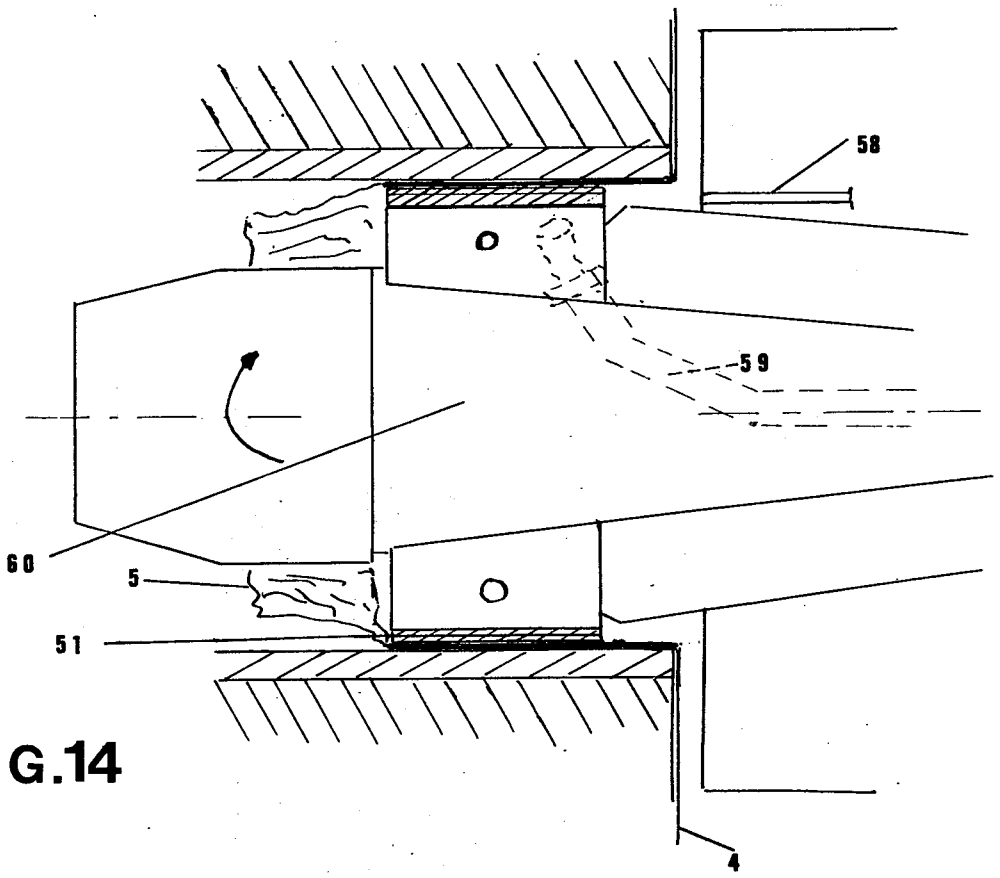

Another method of the invention is illustrated by FIGS. 12, 13 and 14, in which the gripping element consists of a metal strip 50 which is wound in the form of successive turns on the end of a mandrel 60 activated as in the previous embodiment by a portable pistol grip device which is not shown.

FIG. 12 illustrates, schematically and in end view, the winding of the metal strip around the mandrel 60. This mandrel 60, as has already been said, can be moved longitudinally by means of the shaft of a pistol grip device and its end comprises elements 54, 55 and 56 which can be spread outwards.

To facilitate the positioning of the metal strip, one of the elements, for example element 55, has a longitudinal groove 57 into which the end of the metal strip is placed, the strip thereafter being wound about the mandrel, preferably to form at least two successive turns 51 and 52 which overlap.

The holding of the strip which has been wound in this way is obtained by any appropriate means, for example, by means of a retractable finger 58.

As in the preceding embodiment, the ends 5 of the edges of a protective sheet 4 are inserted into the bore 3 of the tube carrying the material 1. When this is done, as is shown in FIG. 13, the end of the mandrel 60 is fitted into the cavity of the said tube.

Figure 4:
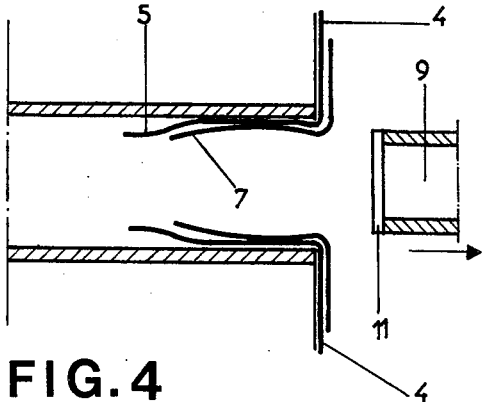
Figure 5:
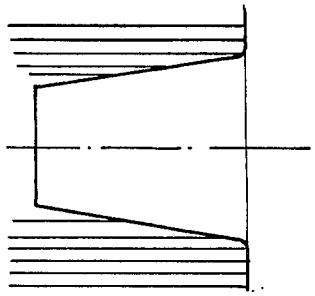
FIGS. 5, 8 and 10 show different forms of gripping rings.

After positioning, and as is shown in FIG. 4, the finger 58 is retracted and deformation of the gripping element constituted by the roll of metal strip about the said mandrel 60 is caused. This deformation is obtained by virtue of the elements 54, 55, and 56 which the mandrel contains and which can be spread outwards. On spreading, the said elements cause the turns of wound strip to slide and the end 5 of the protective sheet 4 to be held fast against the internal wall 3 of the tube.

Advantageously, at the same time as the volume occupied by the gripping element is increased in this way, the mandrel is caused to turn in the reverse direction to the winding of the metal strip; this further improves the gripping.

Furthermore, it is advantageous to provide, on at least one part of the surface of the metal strip, a glue, for example of the type which can be activated by heat. After expansion of the gripping element, the adhesive properties of the material are developed by heating, this heating being produced directly by means of a hot air inlet pipe 59 which opens out in the proximity of the surface of the mandrel.

Figure 10:
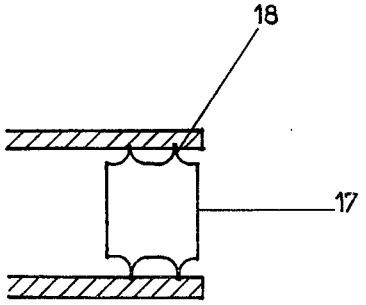

In another variant illustrated by FIG. 10, the ring 17 is subjected to the action of a means of deformation (not shown) having parts which project at its periphery, the said parts causing the formation of protuberances 18 in the ring, which protuberances penetrate to a greater or lesser extent to the tube itself; this further improves the gripping of the protection envelope.

Figure 9:
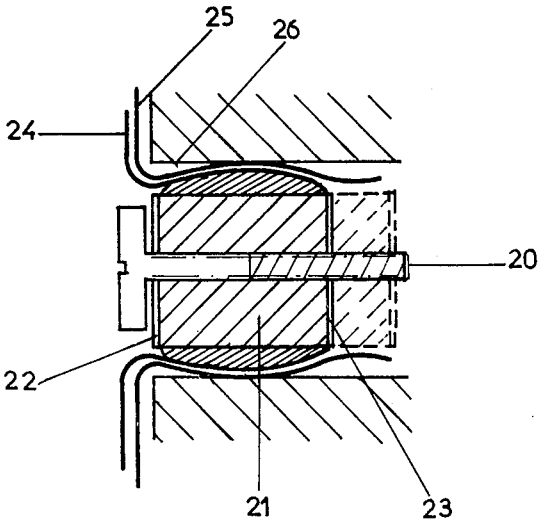
FIG. 9 illustrates another embodiment of the expansion means.

Finally, in certain cases, it can be advantageous to use, as is shown in FIG. 9, a gripping element which can optionally remain on the tube after the operation of gripping the protective envelope.

Such a device can for example consist of a threaded rod 20 carrying a sleeve 21 which can, for example, be compressed by virtue of the action of plates of the screw type 22 and 23. When the rod is lined up, the sleeve 21 is compressed and deforms the ring 24 which is fitted thereon and which therefore secures the sheet 25 against the tube 26.

Figure 6:
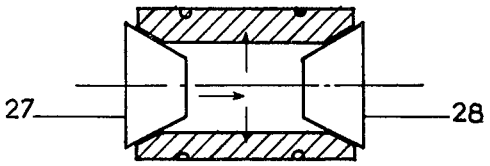
FIGS. 6 and 7 illustrate one embodiment of the expansion means.
Figure 7:
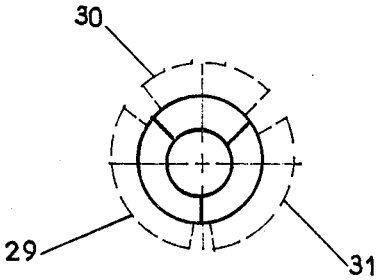

FIGS. 6 and 7 illustrate another embodiment of the deformation component, which in this case, consists of a device having two movable cones 27–28 which, when they are brought closer together, cause the spreading of the segments 29–30–31 fitted between these cones, the spread position of the segments being shown by dotted lines in FIG. 7.

As stated above, the gripping elements in accordance with the invention can comprise a flange which is caused to press against the end of the roll, and this has numerous advantages, such as good location of the gripping element when it is being positioned, a better gripping of the protective sheet, protection of the ends of the roll and the possibility of using protective end-plates, and furthermore makes it possible to store them more easily by stacking them on top of one another.

Finally it should be noted that this flange facilitates the extraction of the rings during the use of the roll, although in certain cases, for example, if it is not desired to reuse the carrier tubes, it is quicker and more economical to simply cut the outer envelope to remove the flange, without having to remove the gripping elements. Furthermore, such a possibility is made feasible because of the low cost of the gripping elements according to the invention.

I claim:

1. In a method of fixing a protective cover sheet around a roll of material such as carpet, fabric, or the like, where such roll is formed around a carrier tube having a longitudinal bore and wherein the cover sheet has a width sufficient that the marginal end portions thereof cover the ends of the roll, the improvement comprising the steps of:

inserting the marginal end portions of the cover sheet into the bore;

introducing into the bore expansion means carrying a gripping element, the gripping element comprising a metal strip having first and second ends and being wound in at least two successive turns to form a spiral having a substantially circular cross-section, the gripping element being radially expandable by application of an internal force thereto to any size within a range of diameters ranging from a first chosen diameter to a second diameter equal to the diameter of the bore, the gripping element being at the first diameter when introduced into the bore; and expanding said expansion means from engagement with the gripping element at the first diameter to engagement at a diameter approximately equal to the second diameter whereby the gripping element firmly urges and holds the marginal end portions of the material against the inner wall of the bore.

2. A method as claimed in claim 1 wherein the step of expanding the expansion means is carried out by actuating a pistol device associated with the expansion means.

3. A method as claimed in claim 1 including the step of adhering the turns of the gripping element to each other after the element has been expanded to hold the marginal end portions of the material.

4. A method as claimed in claim 3 including the step of engaging the gripping element metal strip proximate its second end by means of a retractable finger for holding the turns of the gripping element in the desired position.

5. A method as claimed in claim 4 including the step, performed after the marginal end portions of the material are urged against the bore, of rotating the expansion means in the reverse direction of the turns of the metal strip to improve the gripping.

* * * * *